US005413236A

United States Patent [19]

Kenevan

[11] Patent Number: 5,413,236

[45] Date of Patent: May 9, 1995

[54] MODULAR SHIPPING CONTAINER

[76] Inventor: Timothy P. Kenevan, 3650 Ridgewood Dr., Willits, Calif. 95490

[21] Appl. No.: 86,726

[22] Filed: Jul. 2, 1993

[51] Int. Cl.[6] ..... B65D 6/24

[52] U.S. Cl. ..... 220/4.28; 220/4.27; 220/648; 220/23.4

[58] Field of Search ..... 52/79.9; 217/66, 65, 217/12 R, 13, 43 R, 45; 220/1.5, 4.27, 4.26, 648, 646, 23.2, 23.4, 23.83, 23.6, 4.28

[56] References Cited

PUBLICATIONS

1992 Thomas Register: Record 4623/p. 11; Record 12037/p. 13; Record or p. 18686/PAL (PAL/18686); Record or p. 18689/PAL; Record or p. 18699/PAL; Record or p. 18700/PAL (PAL/18700); Record or p. 18701/PAL; Record or p. 6218/CON (CON/6218); Record or p. 6228/CON (CON/6228); Record or p. 6230/CON (CON/6230); Record or p. 6273/CON; Record or p. 6281/CON; Record or p. 6285/CON; Record or p. 6288/CON (CON/6288); Record or p. 6289/CON; Record or p. 6296/CON (CON/6296); Record or p. 6972. [17 Records Total, 18 Sheets of Paper].

*Primary Examiner*—Stephen J. Castellano
*Attorney, Agent, or Firm*—Trask, Britt & Rossa

[57] ABSTRACT

A modular container for use in shipping is disclosed. The container includes a floor element, a plurality of upstanding frame members which are positioned about the floor element, and a plurality of wall panels. The wall panels are associated with the frame members to form the sidewalls of the container. A cover is positioned atop the frame members. The floor element is fitted with tab extensions and recess openings which facilitate the interlocking of a plurality of floor elements to form a floor element assembly. Likewise, the cover is fitted with tab extensions and recess openings which facilitate the interlocking of a plurality of covers to form a cover assembly. The container is includes a strap arrangement which permits the floor element and the cover to be urged into abutment against the frame elements and the wall panels thereby forming a container. The invention discloses a structure for interconnecting a plurality of floor elements, covers, frame elements and wall panels to form a variety of dimensionally unique containers adapted for storing articles of varied dimensions.

10 Claims, 9 Drawing Sheets

MODULAR SHIPPING CONTAINER

BACKGROUND OF THE INVENTION

1. Field of the Invention

This invention relates to the field of cargo transport. More specifically, the invention is directed to modular containers for use in facilitating the shipment of cargo by conventional truck trailers.

2. State of the Art

A significant portion of the cargo transported by conventional truck trailers is carried on behalf of shippers whose individual shipments require less carrying capacity than that afforded by an entire empty truck trailer. These types of shipments are known in the trade as "less than truckload" or "LTL" shipments.

Several substantial problems are created in the efficient handling of LTL freight shipments. Due to the logistics of handling these types of shipments, any particular shipment is oftentimes transferred several times from trailer to trailer before the shipment eventually reaches its destination. The multiple times which the shipment is handled not only creates significant labor costs, but furthermore such handling frequently results in damage or loss to the shipment. Billing errors which arise from misclassification of the shipment are another problem associated with the present methods of handling these types of shipments.

The costs associated with warehousing the shipment until it can be transferred to the next trailer also creates a significant overhead for handling these types of shipments. Furthermore, due to the odd sizes of many shipments of this type, it is also difficult to efficiently load a truck trailer to efficiently utilize the entire cargo space of the trailer.

There exists a need for container structures which are adapted for compartmentalizing LTL-type shipments so as to address the problems outlined above.

SUMMARY

The instant invention provides a container formed of a floor element, a plurality of frame elements in association with a plurality of wall panels, and a cover. The various structural members of the container are configured to permit their ready disassembly, whereby the container may be disassembled into a number of component parts adapted for storage in a spatial area which is considerably smaller than that occupied by the assembled container.

The structural members of the container are configured to permit their assembly into containers having various storage capacities. This feature permits the user to utilize the structural members for constructing containers individually sized to encase shipments having various configurations and dimensions.

The floor elements of the invention may be adapted to include interconnecting means suitable for detachably interconnecting two or more floor elements to one another to form a floor element assembly having an increased dimensional surface area. The covers may likewise include such interconnecting means adapted to facilitate the detachable interconnection of multiple covers to one another to form a cover assembly having increased dimensions. In one embodiment the interconnecting means may take the form of interlocking tabs in association with recess openings.

The frame elements are configured to be detachably coupled with a floor element and a cover to interconnect the floor element with a respective cover. In those container constructions which include multiple floor elements and covers, multiple frame elements can be used to interconnect a floor element assembly with a cover assembly.

The container may be provided with a compression means adapted for urging the floor element and the cover into abutment against the frame elements and wall panels positioned therebetween. This results in the creation of a compression bond or joint between the floor elements, the cover and the associated frame elements and wall panels. It should be understood that likewise in those constructions which utilize a floor element assembly and cover assembly, such a compression means may also be used.

In one construction this compression means may include the use of a strap which is trained about the perimeter of the container. In these constructions, the floor elements and the covers may be provided with a number of slotted openings which are oriented to permit the user to position a strap or straps about the assembled container. This strap may be used as a means of providing security to the container. In one embodiment this strap may be positioned, generally in a vertical plane, about the container so as to urge the cover and floor element into abutment, i.e. into compression, against the frame members interposed therebetween to thereby provide a secured configuration.

The container may also include an auxiliary strap arrangement disposed laterally about the sidewall defined perimeter of the container. This auxiliary strap arrangement provides a degree of structural integrity to the container by urging the frame members into abutment against the wall panels.

BRIEF DESCRIPTION THE DRAWINGS

DETAILED DESCRIPTION OF THE ILLUSTRATED EMBODIMENTS

Figure 1:
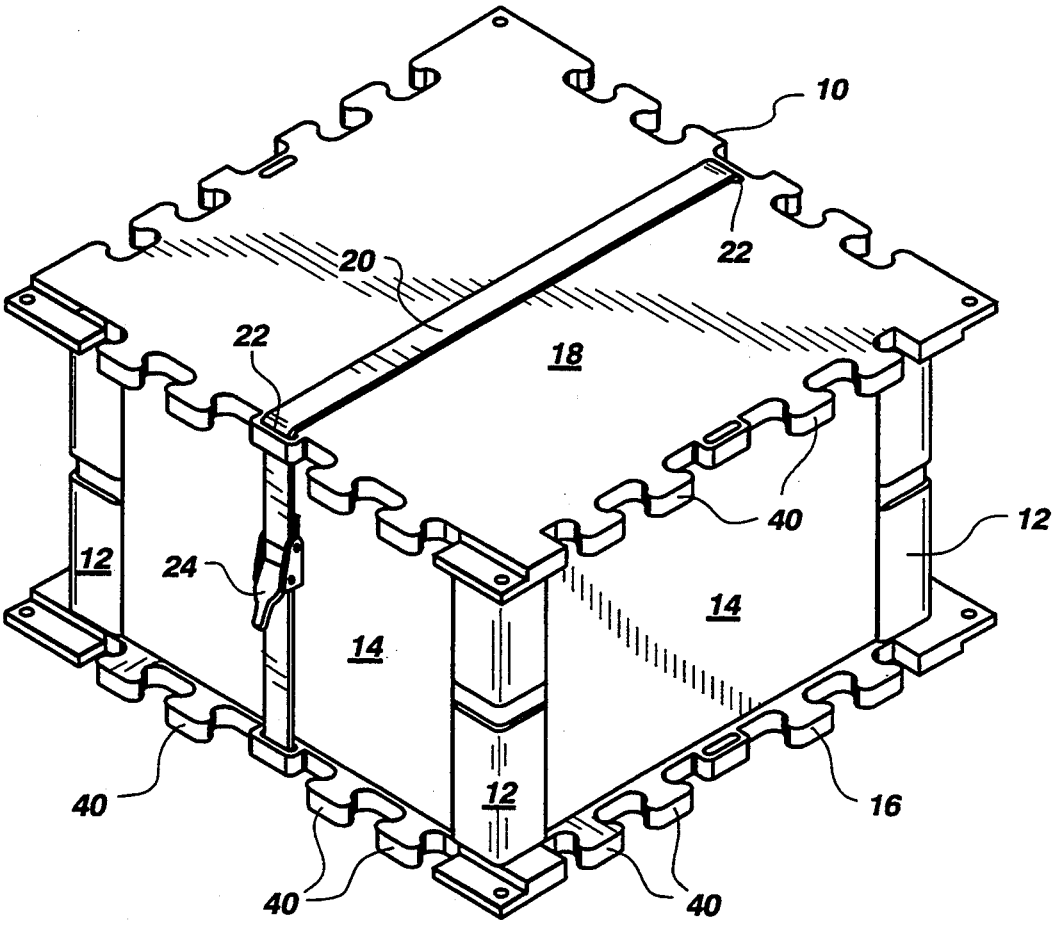
FIG. 1 is an elevated perspective view of a container structure of the instant invention.

As shown in FIG. 1, a container 10 of the instant invention includes a plurality of upstanding frame members 12 which are disposed spacedly from one another to define generally the corners of a quadrilateral. Each container 10 also includes a plurality of wall panel members 14. Each wall panel member 14 is disposed between a pair of adjacent upstanding frame members 12. The floor element 16 of the container 10 is formed by a generally planar element. A cover 18 is positioned atop the frame members 12 and wall panels 14 to enclose the interior of the container 10.

Each of the various elements of the container 10 namely frame members 12, wall panels 14, floor element 16 and cover 18 is adapted and otherwise configured to interact with its adjacent elements to form a detachably interlocked construction. As shown in FIG. 1, the cover 18 defines a plurality of slots 22. Each slot 22 is positioned in a respective side portion of the cover 18. Each slot 22 extends through the complete thickness of the cover 18 and is configured to permit the passage therethrough of a cable or strap 20. Likewise the floor element 16 also defines a plurality of slots 22 within its particular structure. The respective slots 22 in both the cover 18 and the floor element 16 are so configured that when the respective cover 18 and floor 16 are positioned on the container 10 itself, the slots 22 in the respective cover 18 and floor element 16 are aligned one with another so as to permit a passage therethrough of the cable or strap 20. As further shown in FIG. 1, these slots are so aligned so as to permit the user to position the cable or strap about the central portion of the container structure so as to encircle the entire container structure. The cable or strap 20 is therefore oriented in a generally vertical plane. A clamping and locking structure of a type well-known in the cable and strap art is affixed to one of the ends of the cable or strap 20 thereby permitting the user to interconnect the opposing ends of the cable or strap and tension the cable or strap about the container structure so as to provide some structural integrity especially in a vertical direction to the container. The cable or strap 20 functions to urge the cover 18 and the floor element 16 into abutment against either the frame members 12 or the wall panels 14 or both.

Figure 2:
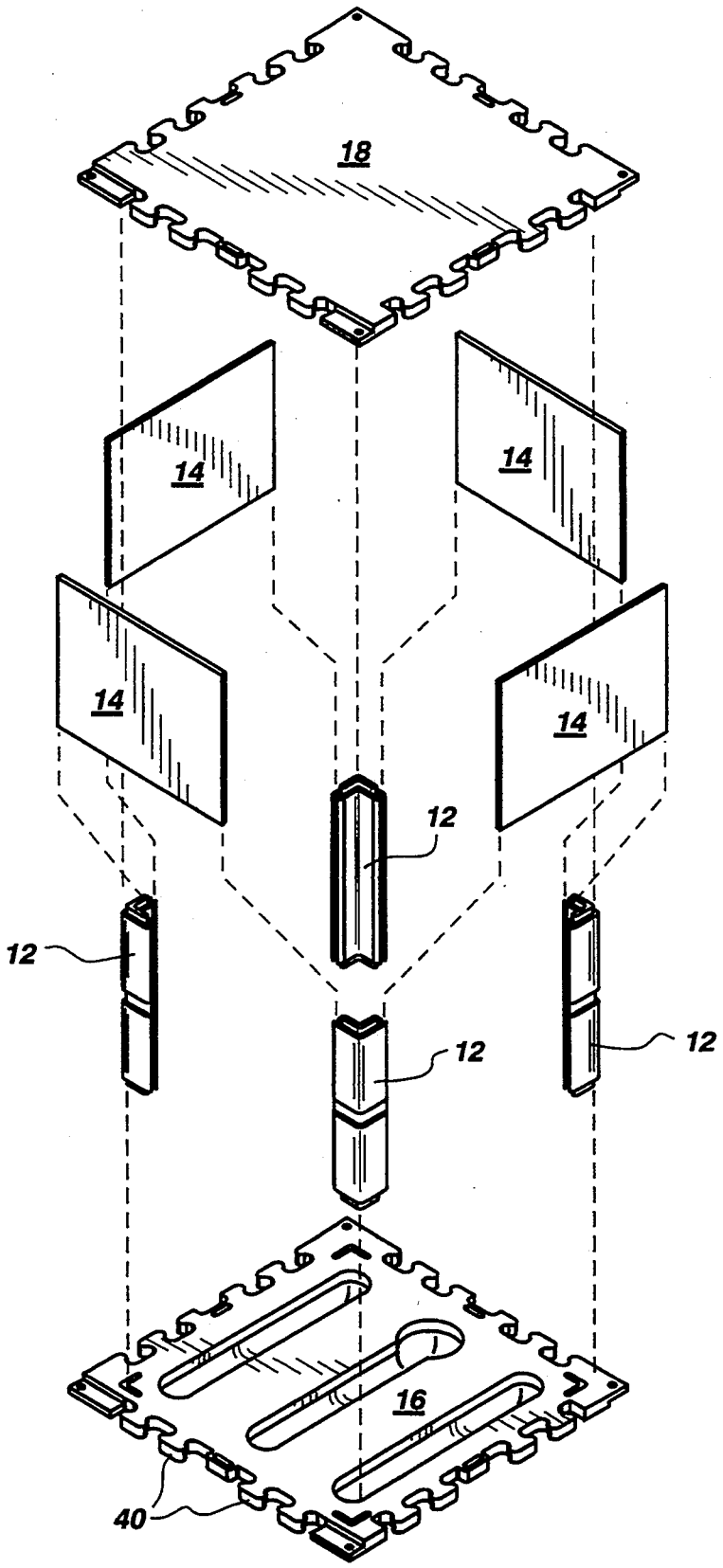
FIG. 2 is an exploded view of the container structure of FIG. 1, wherein the retainer strap has been removed for clarity.
Figure 4:
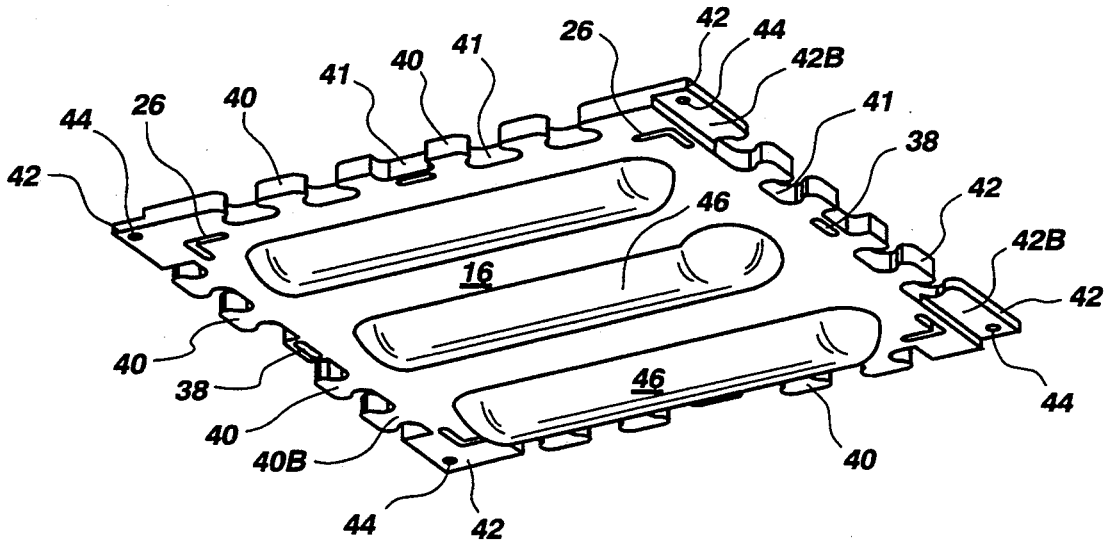
FIG. 4 is an elevated perspective view of the bottom surface of the floor element of the container structure.

FIG. 2 illustrates an exploded view of the container structure of FIG. 1. As shown, the floor element 16 is formed of a generally quadrilaterally- perimetered, planar element having a generally constant thickness over its surface. As further illustrated in FIGS. 4, 5 and 6, the floor element 16 includes on each of its sides or edges, a plurality of tab shaped members 40 which are configured to extent laterally outward away from the general structure of the floor element 16. .As illustrated in FIG. 4, each of these tab shaped members 40 includes a generally elongated region at its end which then tapers to form a neck 40B. The neck is interconnected to the general structure of the floor element 16. Each of the tab members 40 is separated spatially from its adjacent tab elements 40 so as to define a opening 41 therebetween. Each of the openings 41 are configured specifically so as to receive a tab element 40 of an adjacently positioned floor element 16. As shown to advantage in FIG. 6, when adjacent floor elements 16 are positioned contiguous to each other the respective tab members 40 of one floor element 16 are received within the corresponding openings 41 of the adjacent floor element 16. Due to the particular configuration and orientation of the tab members 40 and their corresponding openings 41 in the adjacent floor element 16, the positioning of one floor element 16 contiguous to a second floor element 16 permits a interlocking of the respective tabs and corresponding openings of the two floor elements 16. The two floor elements together form a floor element assembly. It should be understood that a number of floor elements may be interconnected one to another to form a floor element assembly having one of a number of different dimensions. This interlocking function thereby provides a means whereby a plurality of floor elements may be structurally interconnected one to another laterally.

Figure 5:
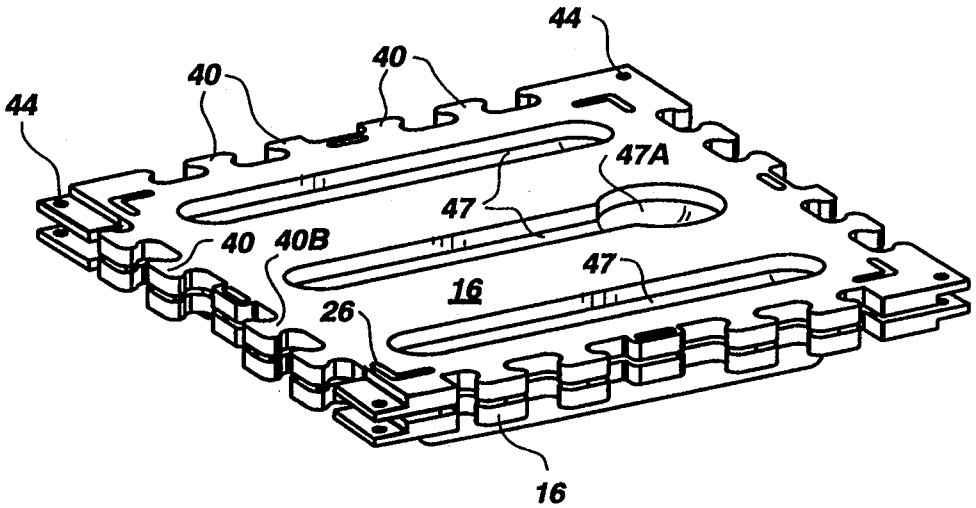
FIG. 5 is an elevated perspective view of two floor elements of a container structure, the floor elements being nested in one another.
Figure 6:
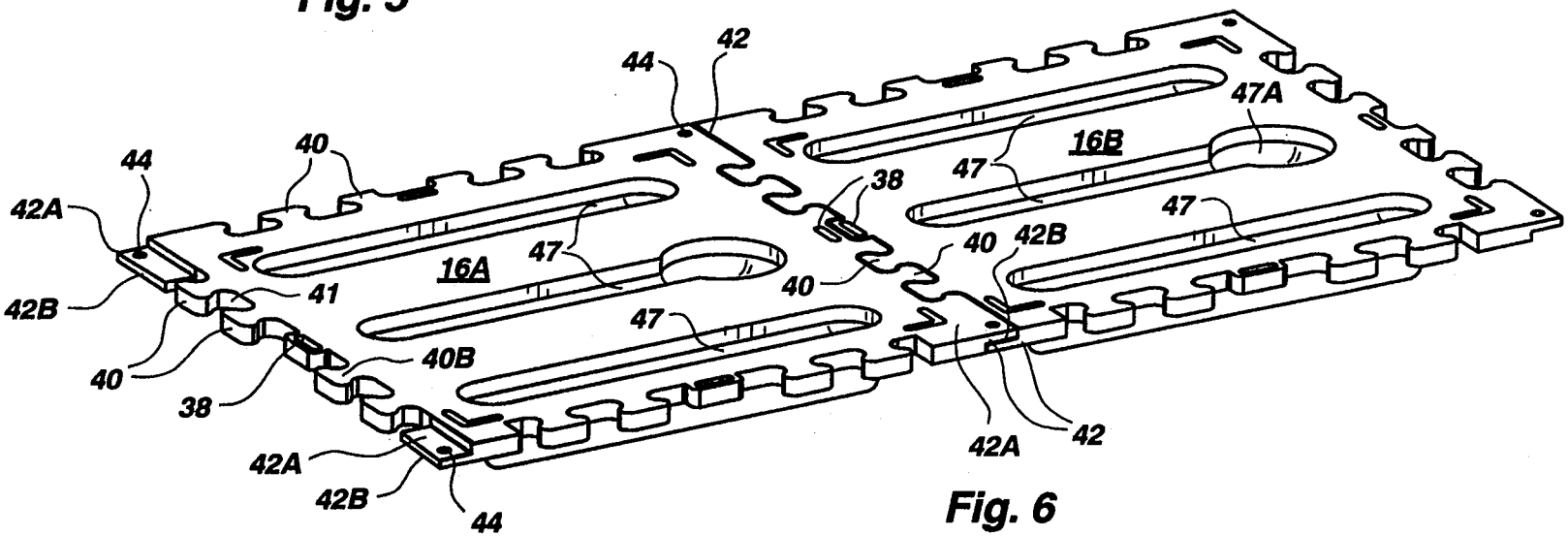
FIG. 6 is a pair of floor elements of the instant invention shown in an interlocked configuration on one of their lateral edges.

On each end of each side of the floor element 16 is positioned a lateral extension 42. As illustrated in FIG. 4, 5 and 6, each extension 42 is dimensioned to be approximately one half of the thickness of its respective floor element. Defined within the body of each extension 42 is an opening 44 which extends through the complete thickness of the floor element 16. The purpose and function of the openings 44 will be explained later. As illustrated, each of the extensions 42 are configured to have a thickness which is preferably approximately one-half of the thickness of the floor element 16. The particular construction of each extension 42 may vary about the perimeter of each floor element 16.

In one preferred construction as shown in FIG. 6, the top surface of the extension 42 is oriented parallel and co-planar with the top surface of the floor element 16A. Whereas the bottom surface 42B is positioned parallel but not co-planar with the general planar surface of the bottom of floor element 16A. The structure of the extensions 42 on a floor element 16B, which may be positioned contiguous to its adjacent floor element 16A, is generally opposite to that previously described for the extension 42 of floor element 16A, i.e., the top surface of the extension 42 of the floor element 16B is not coplanar with the top surface of the floor element 16B, whereas the bottom surface of the extension 42 of the floor element 16B is co-planar with the bottom surface of the floor element 16B.

These particular constructions of the extensions 42 permit an interlocking of the respective extensions when the two floor elements 16A and 16B are brought into an interlocking relationship. As shown in FIG. 6 as each of the extensions 42 are brought into an interlocking relationship, the extension 42 of the floor element 16A slides over and above the extension 42 of the floor element 16B. The respective openings 44 in each of the extensions 42 are so configured that when the floor elements 16A and 16B are brought into an interlocking relationship the openings 44 are aligned thereby defining a vertically extending continuous channel which extends through the complete thickness of the two overlapped extensions 42A and 42B.

The floor element 16 defines a plurality of downwardly-directed, generally semi-circular structures 46 which are seen to advantage in FIG. 4. While the structures 46 are illustrated as being semicircular in configuration, it should be understood that the structures could also be of other configurations which are not semicircular. Each of these structures are configured to form a support for the floor element 16 for purposes of supporting the container on an underlying surface such as a floor or the ground. In the preferred construction shown in FIGS. 4, 5 and 6, each of the extensions 46 are configured to have a semi-circular bottom 46A. As seen in FIGS. 5 and 6, the top surface of the floor element 16 defines a plurality of elongate open channels or recesses 47 which are positioned spacedly about the surface of the top surface of floor element 16. Each of these open channels corresponds generally to a respective floor extension 46 which extends from the opposing side of the floor element 16. Each of the open channels 47 is configured to receive a corresponding floor extension 46 of a floor element 16 in a nesting relationship. As shown to advantage in FIG. 5 wherein two floor elements 16 have been nested one into the other. It should be recognized that each of the floor extensions 46 of the cover 18 have been received within a corresponding recess 47 defined within the floor element 16. The open channels 47 are dimensioned to receive and store one or more of the frame members 12 when the container has been disassembled. As may be noted in FIG. 4 and, one of the open channels 47, and its respective extension 46 has been enlarged on one of its ends to form a supplemental storage area which is specifically dimensioned to receive and store the cable or strap 20.

Each floor element 16 also defines a plurality of generally L-shaped slots 26 which are spacedly positioned about the structure of the floor element 16. As shown to advantage in FIGS. 4, 5 and 6, each of these L-shaped slots 26 are positioned proximate a corner of the quadrilaterally-shaped floor element 16. As shown, one leg of the L-shaped slot 26 is positioned to be parallel to its adjacent side of the floor element 16, while the other leg of the slot is positioned to be parallel to the side of the floor element 16, which is adjacent thereto. Each of the slots 26 may be configured to extent either completely through the thickness of the floor element 16 or partially through that thickness. Each of these slots is adapted to receive a flange extension 34 of a respective, upstanding frame member 12. The slots 26 are dimensioned and configured to generally receive and retain a respective frame member 12 in a tight yet detachably secure fashion.

Figure 3:
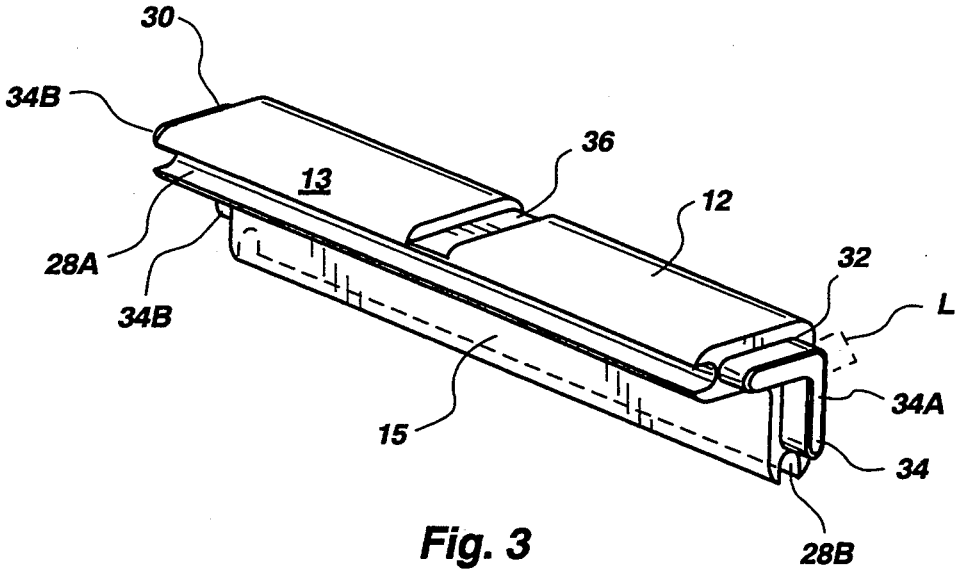
FIG. 3 is an elevated perspective view of an upstanding frame member of the container structure.

As shown in FIG. 3, an upstanding frame member 12 of the instant invention is a generally elongate body having a generally L-shaped cross section. The frame member 12 includes a L-shaped extension 34A positioned on its first end 32; a second L-shaped extension 34B is positioned on the opposing end 30. As shown, each L-shaped extension 34 follows generally the shape and configuration of the cross section of the frame member 12. Extensions 34 are dimensioned to have a length L which may be substantially less than the thickness of its corresponding floor element 16. Alternatively, the length L of the extension 34 may be dimensioned so as to be considerably larger that the thickness of its corresponding floor element 16.

In one construction, each of the frame members 12 is positioned atop its corresponding floor element 16 as shown in FIG. 2 such that each of the extensions 34A extend downwardly into the floor element 16 so as to form a secure and generally rigid interlocking, yet detachable, relationship with the floor element 16. In these particular constructions, the extension 34A may extend either partially or perhaps even completely through the thickness of the floor element 16. It is also contemplated that the length L of the extension 34A may be so configured so as to extend downwardly through the complete thickness of the floor element 16 and furthermore, extend sufficiently beyond the floor element 16 so as to extend beyond the bottom surface 46A of the floor extensions 46. In this later construction, the extensions 34 may actually form feet for the container structure and actually serve as supports for supporting the container 16 above an underlying surface.

Figure 3A:
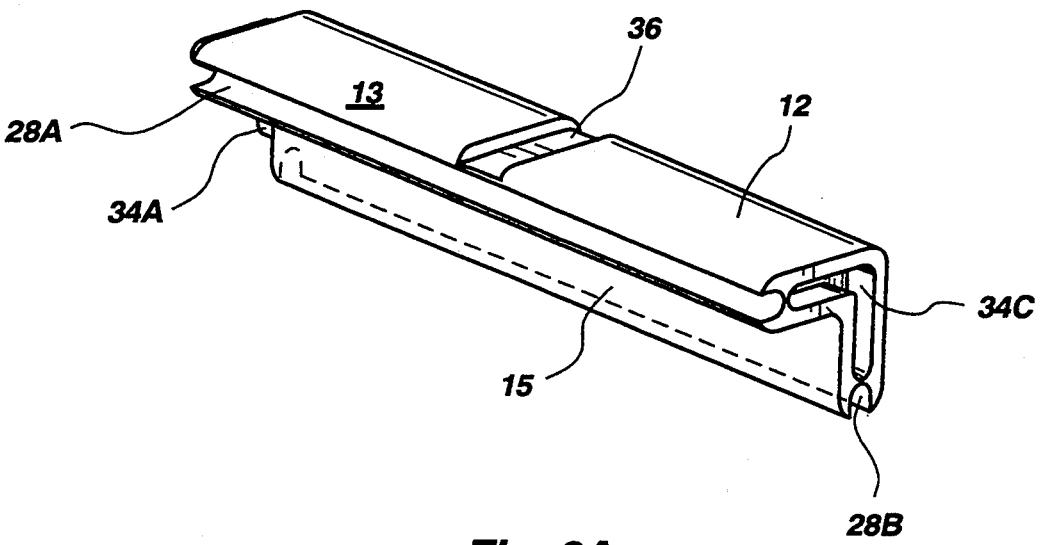
FIG. 3A is a elevated view of an alternative embodiment of an upstanding frame member of the container structure.

FIG. 3A illustrates an alternative construction wherein the second extension of the frame member 12 has been removed and replaced by a correspondingly configured slot 34C. This particular construction is adapted for use in those embodiments wherein one frame member is positioned atop another frame element to form a frame member assembly having an increased dimensional height. In this particular embodiment, the first extension 34A of the upper frame member 12 is inserted into the slot 34C defined on the upper surface of the lower positioned frame member 12. Both the extension 34A and the slot 34C is dimensioned to produce a tight friction fit point adapted to retain the two frame member in a conjoined vertical orientation. This construction is shown to advantage in FIG. 7.

The invention may also utilize a frame member 12 which includes only slots 34C on each of its respective ends. A use of this type of frame member may also include the us of a floor element 16 or cover 18 which defines one or more extensions thereon which structurally correspond to the extensions 34A found on the frame members 12 previously described. The interconnection of the frame members 12 and the corresponding floor elements 16 or covers 18 would be substantially as previously described with the exception that the relative positioning of the extensions and receiving slots would be reversed.

Each frame element 12 defines a pair of channels 28 which extend along one side of each of the respective legs of the L-shaped frame member 12. As shown in FIG. 3, a channel 28A extends along the complete free edge of the leg 13 of the frame 12 whereas a second channel 28B extends along the complete free edge of the leg 15 of the frame member 12. Each of the channels 28A and 28B is formed to have a substantially semi-circular cross section.

Figure 8:
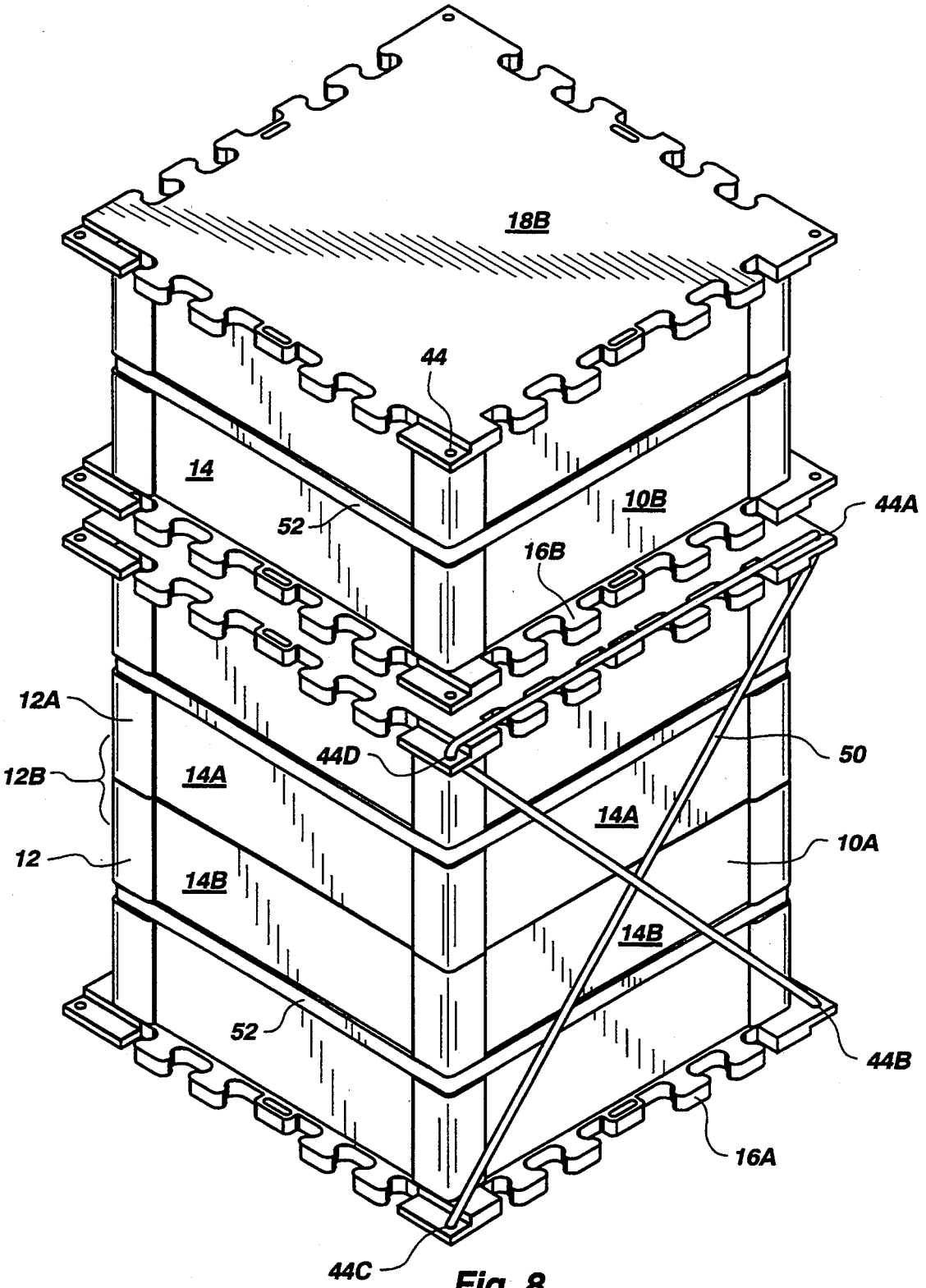
FIG. 8 is another alternative construction of the container of the instant invention wherein a pair of containers are shown interlocked one with another by means of a vertically and horizontally extending cable or strap arrangement.

A channel 36 is defined within each of the legs 13 and 15 of the frame element 12. The channels are interconnected such that they extend in a generally "L" shaped configuration about the exterior surface of the frame member 12. Each of the channels 36 is dimensioned to receive a cable or strap 52. As shown in FIG. 8, a cable or strap 52, corresponding generally to the cable or strap 20 shown in FIG. 1, may be adapted to encircle the exterior of the container 10 and extends in a generally horizontal plane to provide lateral structural integrity to the container 10. As was the case with cable or strap 20, cable or strap 52 may also be fitted on its end with a clasp or locking mechanism adapted to tension and retain the cable or strap 52 in a tension condition about the perimeter of the container 10. The cable or strap 52 is adapted to urge the frame members 12 into abutment with the wall panels 14 interposed therebetween them.

Referring again to FIG. 2, each of the wall panel 14 of the container may be generally planar members having a quadrilateral configuration. Each of the wall panels 14 is dimensioned on its vertical edges to be received into the respective slots 28A and 28B of corresponding upstanding frame members 12. Upon having its edges received within its corresponding frame members 12, each wall panel 14 is held in a generally, upright, vertical orientation to form the side wall of the container 10.

Each cover element 18 is configurationally identical to its corresponding floor element 16, i.e., each cover element 18 includes a plurality of tab members 40 which are positioned spacedly along each of the sides of the cover. Furthermore, each cover element defines a plurality of slots 38 which are positioned on each of the sides of the cover 18 so as to generally be aligned with the corresponding slots 38 in the floor element 16. It should be understood that although the instant description describes a floor element 16 and a cover 18 wherein all of the four sides of each member is fitted with tab members, the invention also embraces constructions wherein only one, two or three sides of the floor element and/or cover is fitted with such tabs.

Each floor element 16 includes a plurality of extension members 46 and corresponding recesses 47. Furthermore, each cover 18 also includes a plurality of L-shaped slots 26 which are positioned about the surface of the cover 18 so as to receive the extensions 34B of each of the upstanding frame members 12.

As shown in FIG. 2, four upstanding frame members 12 are positioned onto the floor element 16 by the insertion of their respective L-shaped flange 34A into respective corresponding L-shaped openings 26 figured within the floor element 16. In this configuration, each of the frame members 12 are positioned in a vertically upstanding orientation. Thereafter, the wall panel elements 14 are positioned within a pair of opposing slots 28 of two adjacent frame members 12 to orient the wall panels 14 in a vertically upright orientation and thereby form a box-like enclosure which extends upwardly from the floor element 16. The cover element 18 is then positioned over and atop the upstanding wall elements 14 so as to position the L-shaped extensions 34B of each of the frame members 12 within respective L-shaped slots 26 defined within the structure of the cover 18. In this particular construction, the floor element 16, frame members 12, wall panels 14 and cover 18 define a generally box-like structure having a hollow interior adapted for receiving and retaining articles to be shipped.

Figure 7:
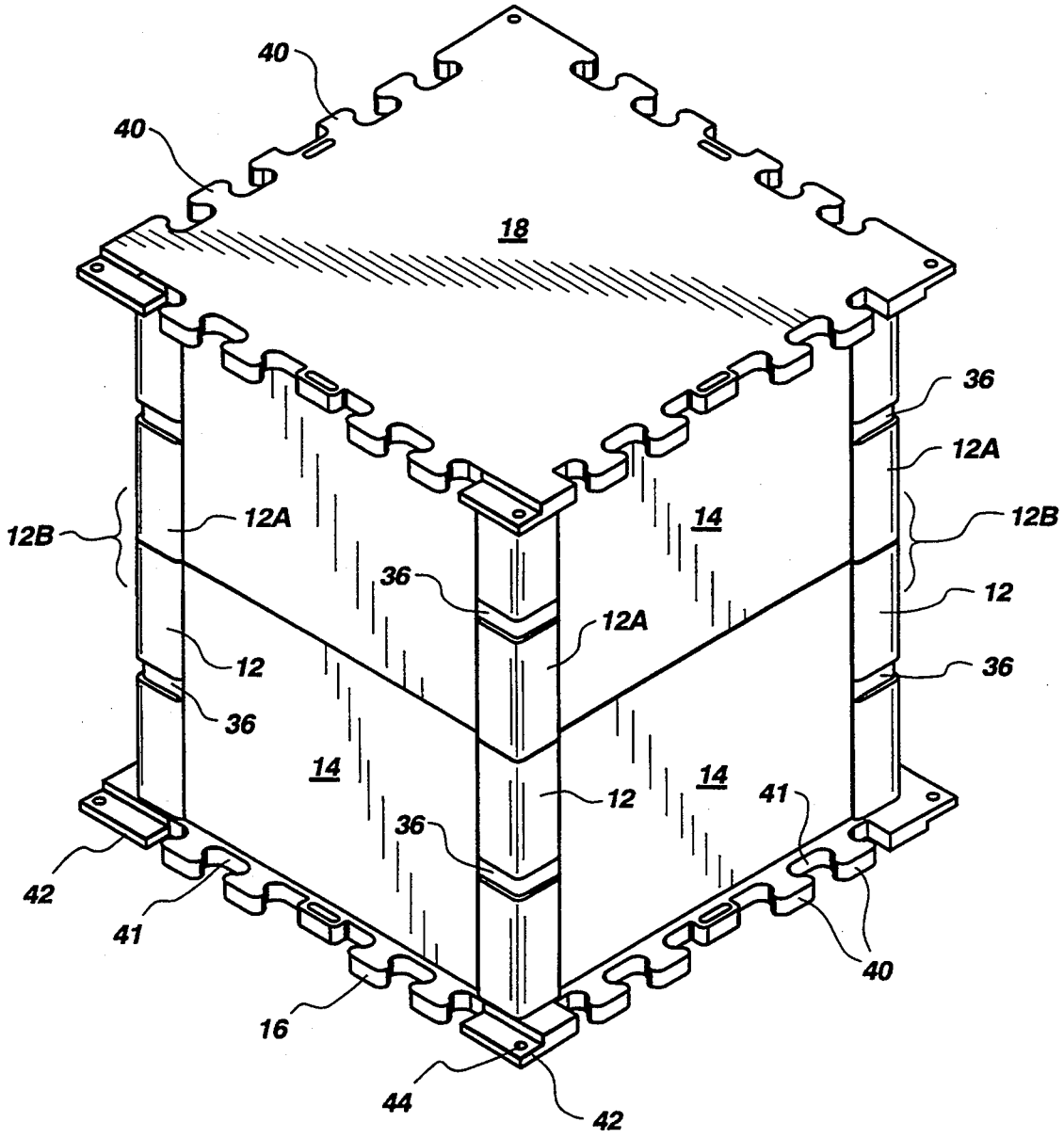
FIG. 7 is an elevated perspective view of a alternative container configuration of the instant invention.

FIG. 7 illustrates an alternative construction wherein the interior volume of the container 10 has been increased by increasing the height of the respective side walls of the container. In this particular construction, a second set of frame members 12A have been positioned atop the first set of frame members 12 to form four augmented frame members 12B. In this construction each of the frame members 12A have been configured to eliminate their extensions 34A. In the place of those extensions, each of the frame members 12A have been configured to define an L-shaped slot therein. Each of the slots has been configured to receive the extension 34B of a respective frame member 12. It follows that upon each of the frame members 12A being positioned atop a respective frame member 12 with the extension 34B of the frame element 12 being inserted into its respective slot within its respective frame member 12A the height of the frame member may be extended or otherwise augmented to a desired height. Thereafter, a pair of wall panels 14 and 14A are inserted into their respective slots 28 of the adjacently positioned, augmented frame member 12B to form the side walls of a container structure. It should be understood that the frame members 12 and the supplementary frame members 12A may be configured in various heights so as to optimize the available cargo carrying space of a trailer in which the containers are to be loaded.

A container 10 may actually be constructed about the shipment so as to correspond generally to the size of that shipment. It is also contemplated that the floor elements, frame members, wall panels and covers may be dimensioned so as to be constructible into containers which are of heights which are readily combinable to equal the interior height of the cargo carrying area of a trailer.

FIG. 8 illustrates a configuration wherein the container of FIG. 1 has been positioned atop the container of FIG. 7. This particular FIG. 8 illustrates a contemplated configuration of containers which have been loaded onto a trailer for purposes of transport. The lower container is fitted with a cable or strap arrangement adapted to add stability in a vertical direction by means of a plurality of cables or straps 50 which have been positioned to pass through the corresponding apertures 44 defined in the respective floor element 16 and cover 18 of the container. As shown, a cable or strap 50A extends through a opening 44A in floor element 16A and thereafter passes through an opening 44B of the cover 18A of container 10A. The cable or strap 50A thereafter passes through an opening 44C in the cover 18A of container 10A. The cable or strap 50A then passes through an opening 44D defined within the floor element 16A of container 10A and thereafter is directed horizontally to a opening 44A also defined within the cover 16A of container 10A. The ends of cable or strap 50A are thereafter secured to one another to form an endless configuration. The ends of the cable or strap may be interconnected with the first end of the cable or strap 50A by means of a clasp or locking mechanism of a type known in the art to facilitate the cable or strap being tensioned about the container.

As further illustrated in FIG. 8, a second cable or strap 50B may also be oriented in a fashion similar to cable 50A about the vertical sides of the container. It should also be understood that these cable or strap arrangements also provide some degree of horizontal, i.e. lateral, stability to the container.

Figure 9:
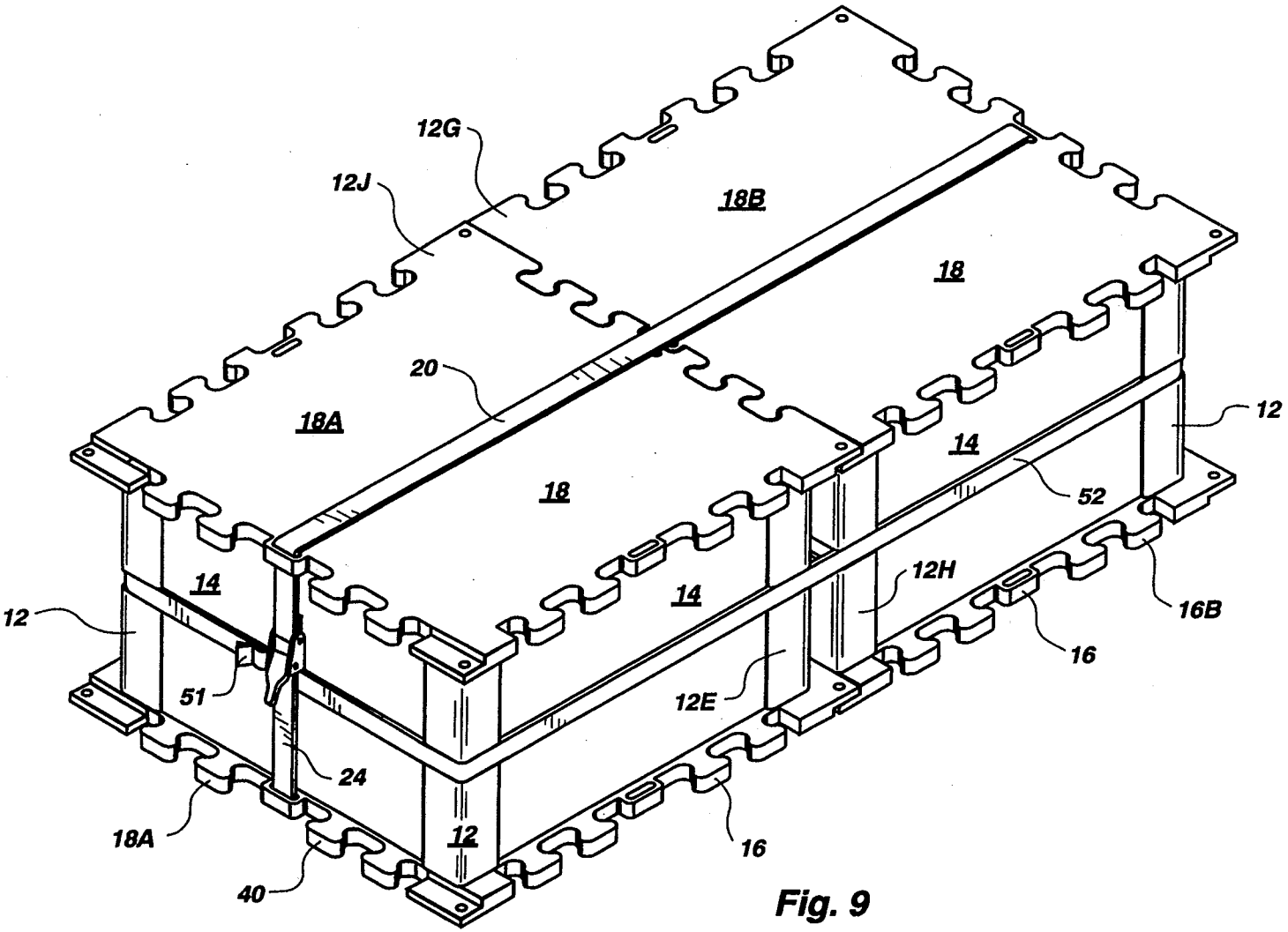
FIG. 9 is an elevated perspective view of an alternative container structure.

FIG. 9 illustrates a construction wherein two floor elements 16 have been interconnected one to another to form a floor element assembly. Further, two covers 18 have been joined along one of their respective edges to form a cover assembly. Eight frame members 12 have been mounted between the cover assembly and the floor member assembly. As shown in part in FIG. 9, a frame member 12 is placed at each corner of the floor element assembly and the cover assembly. Two frame elements are positioned substantially adjacent one another proximate the middle of the elongate sides of the floor element assembly and cover assembly. It should be understood that the middle frame members 12E and 12H are not connected by means of wall panels 14 to the frame elements 12G and 12J which are positioned opposite them on the floor assembly. Instead., the interior of the container structure is free of any wall panels extending through the central region of the hollow interior of the container.

This particular construction illustrates just one of the numerous ways in which the floor elements and covers can be assembled into assemblies and then associated with frame elements and panels 14 to form containers having various storage capacities.

Figure 10:
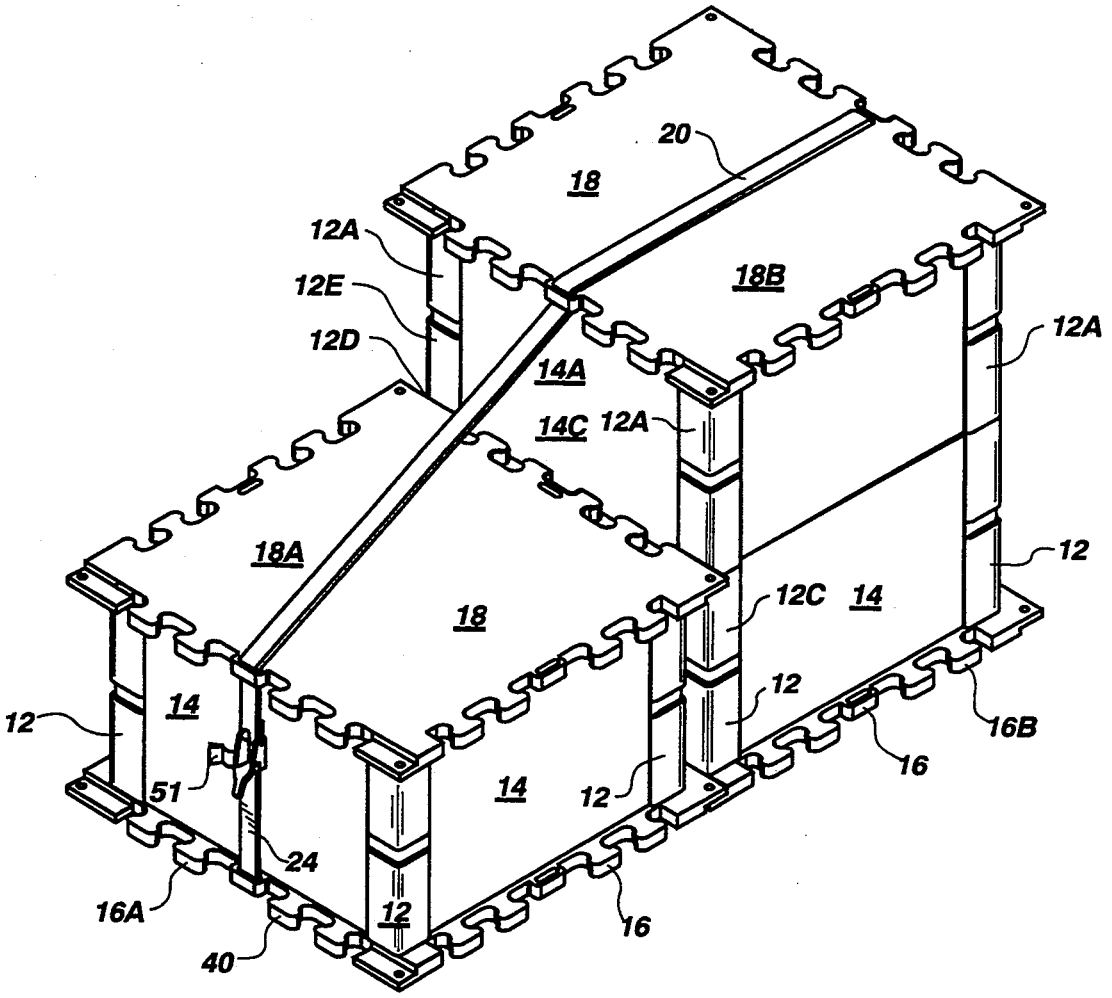
FIG. 10 is an elevated perspective view of a second alternative container structure.

FIG. 10 illustrates a container construction having a substantially "L" shaped configuration when viewed from the side. In this particular construction a second set of frame members 12A have been installed on four of the frame elements 12 in order to increase the height of one half of the container structure. Wall panel elements 14A have been installed between the frame members 12A and a cover 18A has been installed atop the frame members 12A. The wall panel 14C sits atop the cover 18A. No wall panel 14 is positioned between frame element 12C and the frame element 12D which is positioned directly below frame member 12E.

As can be noted from the attached figures, the instant invention provides a means whereby the user may construct a container specifically configured to receive and retain the articles to be shipped. The invention thereby provides a means whereby odd shaped articles may be packed within a transport trailer one on top of the other without fear or concern as to damage which may result from otherwise placing articles which are simply loaded on a pallet and then placed subsequently one on top of another. Since each of the containers may be essentially sealed and if needed be locked, the shipper is given a measure of security as to the articles being transported. The shipper is able to load the container and seal the container. The container then remains sealed until it is delivered at its final destination. The instant container construction thereby lessens the concern as to a subsequent loss of one or more of the articles being shipped as the transport truck is loaded and unloaded at various intermediate destinations.

Those skilled in the art will recognize the embodiments here and before discussed are illustrative of the general principles of the invention. The embodiments herein described are not intended to limit the scope of the claims which themselves recite what applicant regards as his invention.

What is claimed is:

1. A container for use in transporting cargo, said container comprising:

a plurality of floor elements, each said floor element having a plurality of sides, each said side having at least one first extension tab extending outwardly therefrom and at least one first recess opening; each said floor element defining a plurality of first slots therein; said plurality of floor elements being interconnected one to another by an intercooperation of said first extension tabs and said first recess openings to form a floor;

a plurality of frame elements, each frame element having a first extension on its first end and a second extension on its second end; said frame elements being positioned upright on said floor with each said first extension being inserted into a respective first slot; each frame member defining at least one vertical oriented channel therein;

a plurality of wall panels, each wall panel having two opposing sides, each said side being inserted into a respective said channel of a said frame element, said wall panels being oriented upright on said floor;

a plurality of cover elements, each cover element having a plurality of sides, each said cover element side having at least one second extension tab extending outwardly therefrom and at least one second recess opening, each said cover element defining a plurality of second slots therein, said plurality of cover elements being interconnected one to another by said second extension tabs and said second recess openings to form a cover, said cover being positioned atop said frame elements wherein each said second extension is received within a respective said second slot;

a lateral-extending strap positioned about a perimeter of said container defined by said upright wall panels and said frame elements to add structural integrity to said container;

wherein each said frame element defines a channel therein for receiving and retaining said lateral extending strap; and wherein each said first extension tab and each said second extension tab are configured to interlock with a respective recess opening in a respective said floor element and a respective said cover of an adjacently positioned container.

2. The container of claim 1, further including compression means for urging said cover and said floor into abutment against said wall panels and said frame elements.

3. The container of claim 2, wherein said compression means includes a strap positioned about a perimeter of said container to encircle said container.

4. A container for use in transporting cargo, said container comprising:

a plurality of floor elements, each said floor element having a plurality of sides, each said side having at least one first extension tab extending outwardly therefrom and at least one first recess opening; each said floor element defining a plurality of first slots therein; said plurality of floor elements being interconnected one to another by an intercooperation of said first extension tabs and said first recess openings to form a floor;

a plurality of frame elements, each frame element having a first extension on its first end and a second extension on its second end; said frame elements being positioned upright on said floor with each said first extension being inserted into a respective first slot; each frame member defining at least one vertical oriented channel therein;

a plurality of wall panels, each wall panel having two opposing sides, each said side being inserted into a respective said channel of a said frame element, said wall panels being oriented upright on said floor;

a plurality of cover elements, each cover element having a plurality of sides, each said cover element side having at least one second extension tab extending outwardly therefrom and at least one second recess opening, each said cover element defining a plurality of second slots therein, said plurality of cover elements being interconnected one to another by said second extension tabs and said second recess openings to form a cover, said cover being positioned atop said frame elements wherein each said second extension is received within a respective said second slot;

wherein each said first extension tab and each said second extension tab are configured to interlock with a respective recess opening in a respective said floor element and a respective said cover of an adjacently positioned container; and wherein each said floor element is configured to define a plurality of open channels therein configured to receive and store said frame elements in a storage condition.

5. The container of claim 4, wherein a lateral-extending strap is positioned about a perimeter of said container defined by said upright wall panels and said frame elements to add structural integrity to said container.

6. The container of claim 5, wherein each said frame element defines a laterally extending channel therein for receiving and retaining said lateral extending strap.

7. The container of claim 4, wherein said floor element are configured to nest within one another in a storage condition.

8. The container of claim 7, wherein said compression means includes a strap positioned about a perimeter of said container to encircle said container and wherein one of said open channels is dimensioned larger than the remaining open channels to permit the storage of said strap therein.

9. A container for use in transporting cargo, said container comprising:

a plurality of floor elements, each said floor element having a plurality of sides, each said side having at least one first extension tab extending outwardly therefrom and at least one first recess opening; each said floor element defining a plurality of first slots therein; said plurality of floor elements being interconnected one to another by an intercooperation of said first extension tabs and said first recess openings to form a floor;

a plurality of frame elements, each frame element having a first extension on its first end and a second extension on its second end; said frame elements being positioned upright on said floor with each said first extension being inserted into a respective first slot; each frame member defining at least one vertical oriented channel therein;

a plurality of wall panels, each wall panel having two opposing sides, each said side being inserted into a respective said channel of a said frame element, said wall panels being oriented upright on said floor;

a plurality of cover elements, each cover element having a plurality of sides, each said cover element side having at least one second extension tab extending outwardly therefrom and at least one second recess opening, each said cover element defining a plurality of second slots therein, said plurality of cover element being interconnected one to another by said second extension tabs and said second recess openings to form a cover, said cover being positioned atop said frame elements wherein each said second extension is received within a respective said second slot;

a lateral-extending strap positioned about a perimeter of said container defined by said upright wall panels and said frame elements to add structural integrity to said container;

wherein each said frame element defines a channel therein for receiving and retaining said lateral extending strap.

10. A container for use in transporting cargo, said container comprising:

a plurality of floor elements, each said floor element having a plurality of sides, each said side having at least one first extension tab extending outwardly therefrom and at least one first recess opening; each said floor element defining a plurality of first slots therein; said plurality of floor elements being interconnected one to another by an intercooperation of said first extension tabs and said first recess openings to form a floor;

a plurality of frame elements, each frame element having a first extension on its first end and a second extension on its second end; said frame elements being positioned upright on said floor with each said first extension being inserted into a respective first slot; each frame member defining at least one vertical oriented channel therein;

plurality of wall panels, each wall panel having two opposing sides, each said side being inserted into a respective said channel of a said frame element, said wall panels being oriented upright on said floor;

a plurality of cover elements, each cover element having a plurality of sides, each said cover element side having at least one second extension tab extending outwardly therefrom and at least one second recess opening, each said cover element defining a plurality of second slots therein, said plurality of cover element being interconnected one to another by said second extension tabs and said second recess openings to form a cover, said cover being positioned atop said frame elements wherein each said second extension is received within a respective said second slot;

a lateral-extending strap positioned about a perimeter of said container defined by said upright wall panels and said frame elements to add structural integrity to said container;

wherein each said floor element is configured to define a plurality of open channels therein configured to receive and store said frame elements in a storage condition.

* * * * *